United States Patent [19]

Miller et al.

[11] Patent Number: 4,911,832

[45] Date of Patent: Mar. 27, 1990

[54] AUTOMATIC DRAIN SYSTEM TREATMENT APPARATUS

[75] Inventors: Adam C. Miller, Phoenix; Mitchell M. Hazar, Scottsdale; William G. Harvey, Glendale, all of Ariz.

[73] Assignee: Grease Genie, Inc., Phoenix, Ariz.

[21] Appl. No.: 251,355

[22] Filed: Sep. 30, 1988

Related U.S. Application Data

[62] Division of Ser. No. 124,151, Nov. 23, 1987, Pat. No. 4,797,208.

[51] Int. Cl.[4] ..... C02F 3/00

[52] U.S. Cl. ..... 210/86; 210/89; 210/139; 210/141; 210/198.1; 435/262; 137/240; 134/57 R; 134/95; 134/169 R

[58] Field of Search ..... 210/606, 610, 611, 614, 210/632, 737, 87, 88, 89, 138, 139, 141, 198.1, 86; 435/262; 137/240; 134/57 R, 95, 169 R

[56] References Cited

U.S. PATENT DOCUMENTS

| | | | |
|---|---|---|---|
| 1,665,029 | 4/1928 | Hartnett | 137/240 |
| 2,245,767 | 6/1941 | Eickmeyer et al. | 210/86 |
| 3,242,055 | 3/1966 | de Lucia | 210/606 |
| 3,283,781 | 11/1966 | Boyer | 210/198.1 |
| 3,506,582 | 4/1970 | Gertzman | 210/632 |
| 3,672,391 | 6/1972 | Livingston et al. | 137/240 |
| 4,666,606 | 5/1987 | Heinicke | 210/632 |
| 4,670,149 | 6/1987 | Francis | 210/150 |
| 4,797,208 | 1/1989 | Miller et al. | 210/606 |
| 4,810,385 | 3/1989 | Hater et al. | 210/610 |

*Primary Examiner*—Richard V. Fisher
*Assistant Examiner*—Christopher Upton
*Attorney, Agent, or Firm*—Nixon & Vanderhye

[57] ABSTRACT

An apparatus for automatically treating a drain system to prevent or at least minimize clogging problems particularly in grease traps of the type provided in restaurants and other food preparation establishments. The apparatus includes a valve for directing fresh water into the grease trap for pretreating the trap in preparation for the injection of bioactive liquid cultures by the pump. The liquid cultures liquify and digest contaminants in the grease trap which are flushed therefrom by fresh water. The apparatus is controlled by a system which cyclically operates the apparatus in accordance with a preferred operational sequence and at adjustably variable time periods.

14 Claims, 6 Drawing Sheets

AUTOMATIC DRAIN SYSTEM TREATMENT APPARATUS

This is a division of application Ser. No. 07/124,151, filed Nov. 23, 1987 and now U.S. Pat. No. 4,797,208.

BACKGROUND OF THE INVENTION

1. Field of the Invention

This invention relates in general to the cleaning and treatment of drain systems and more particularly to an apparatus for automatically and periodically flushing and supplying an active liquid culture to such systems for liquifying and digesting the fats, grease and other contaminants which clog drain systems.

2. Description of the Prior Art

As is well known in the art, complex proteins, cellulose, starch, fats, grease and other contaminants can cause drain clogging problems, and this problem is particularly acute in the food preparation business. Due to the large quantities of oils, fats, starch and grease, which are used in the preparation of food, or are a by-product of the preparation, restaurants and other food preparation establishments provide what are referred to as grease traps at the input points to the septic systems in the food preparation areas. Grease traps are used to collect the oils, fats, grease and other contaminants to prevent them from entering septic systems and impairing the operation of the septic systems.

The grease, oils, fats and other contaminants which find their way into the grease traps of food preparation establishments tend to solidify and clog the grease traps. For this reason, bioactive liquid cultures have been devised to liquify and digest these contaminants to prevent or at least reduce the occurrence of grease trap clogging problems. The problem with this is that the bioactive liquid cultures must be injected into the grease traps at regular intervals, and as with any routine, and unpleasant chore, it is often overlooked and in some cases simply ignored. For this reason, many food preparation establishments have drain clogging problems from time to time which are expensive to overcome and disruptive of business. Some establishments retain the services of grease trap cleaning and maintenance companies which take care of this problem by injecting the liquid cultures into the grease traps on a routine basis and cleaning the drain system when and if needed. However, the services of such companies are expensive.

Therefore, a need exists for a new and useful automatic drain system treatment apparatus which overcomes some of the problems and shortcomings of the prior art.

SUMMARY OF THE INVENTION

In accordance with the present invention, a new and useful apparatus is disclosed for automatically and periodically treating drain systems per se. The apparatus is ideally suited for treating the grease traps and drain systems of food preparation establishments to prevent, or at least reduce, clogging problems resulting from oils, fats, grease and other contaminants associated with the preparation of food.

The apparatus includes a flushing means, liquid culture injection means and a control system which automatically operates the apparatus at adjustably predetermined intervals and operating durations in accordance with a preferred operational sequence.

The flushing means includes a normally closed solenoid valve that is coupled to receive water from a suitable source, such as a municipal water supply, and direct it via a liquid delivery conduit to the grease trap whenever the solenoid valve is actuated to its open position, with such actuation being accomplished twice per operating cycle of the apparatus. The first actuation of the flushing solenoid valve is accomplished at the beginning of an operating cycle and directs water to the grease trap for accomplishing two objectives that insure that the contents of the grease trap will not impair the effectiveness of the bioactive liquid cultures that are to be subsequently injected into the grease trap. The first objective of supplying water to the grease trap at the beginning of the operational cycle is to insure that the contents of the grease trap are cooled to a temperature which is below the temperature at which the bioactive liquid cultures begins to lose their effectiveness. This may not be a problem in some cases, but grease traps in many food preparation establishments may contain very hot water such as from a dishwasher or the like. The second objective accomplished by the initial flushing operation is to purge, or at least dilute, any caustic compounds which could kill the bacteria of the liquid cultures.

The second actuation of the solenoid valve for supplying water to the grease trap, is accomplished subsequent to the injection of the bioactive liquid cultures, and causes liquified and digested contaminants to be flushed out of the grease trap into the septic system. The bioactive liquid cultures will, of course, be flushed out of the grease trap along with the treated contaminants and will continue to react with contaminants in the septic system.

The bioactive liquid cultures injection means of the apparatus of the present invention includes a pump which is operable to extract the liquid cultures from a supply container and direct it via the liquid delivery conduit into grease trap.

The control system of the apparatus of the present invention includes timing devices which interact with logic circuitry to provide a preferred operational sequence, or cycle, which is accomplished at predetermined intervals and for predetermined operational durations that are adjusted to suit the treatment requirements of the particular drain system to be treated.

Accordingly, it is an object of the present invention to provide a new and useful apparatus for automatically treating a drain system for preventing or at least substantially reducing clogging of the drain system.

Another object of the present invention is to provide a new and useful drain system apparatus for automatically treating a drain system at adjustably predetermined intervals and at adjustably predetermined operational durations to prevent or at least substantially reduce the clogging problems of the drain system.

Another object of the present invention is to provide an automatic drain system treatment apparatus which is ideally suited for use with grease traps of the type used in conjunction with drain systems of food preparation establishments to prevent or at least substantially reduce the clogging problems resulting from oil, fats, grease and other contaminants used in the preparation of food or as a by-product of the food preparation.

Another object of the present invention is to provide an automatic drain system treatment apparatus of the above described character which includes means for periodically injecting bioactive liquid cultures into the grease trap of the drain system for liquifying and digesting the contaminants in the grease trap and the associated drain system.

Another object of the present invention is to provide an automatic drain system treatment apparatus of the above described type which includes a flushing means for injecting water into the grease trap prior to the injection of the bioactive liquid cultures to precondition the grease trap to insure maximum effectiveness of the subsequently injected bioactive liquid cultures and for again injecting water into the grease trap subsequent to the injection of the bioactive liquid cultures for flushing of the grease trap.

Still another object of the present invention is to provide an automatic drain system treatment apparatus of the above described character which further includes a control system which operates the means for injecting the bioactive liquid cultures and the flushing means in a preferred operational sequence that is accomplished at adjustably predetermined intervals and for adjustably predetermined operational durations.

The foregoing and other objects of the present invention as well as the invention itself, may be more fully understood from the following description when read in conjunction with the accompanying drawings.

DESCRIPTION OF THE PREFERRED EMBODIMENT

Figure 1:
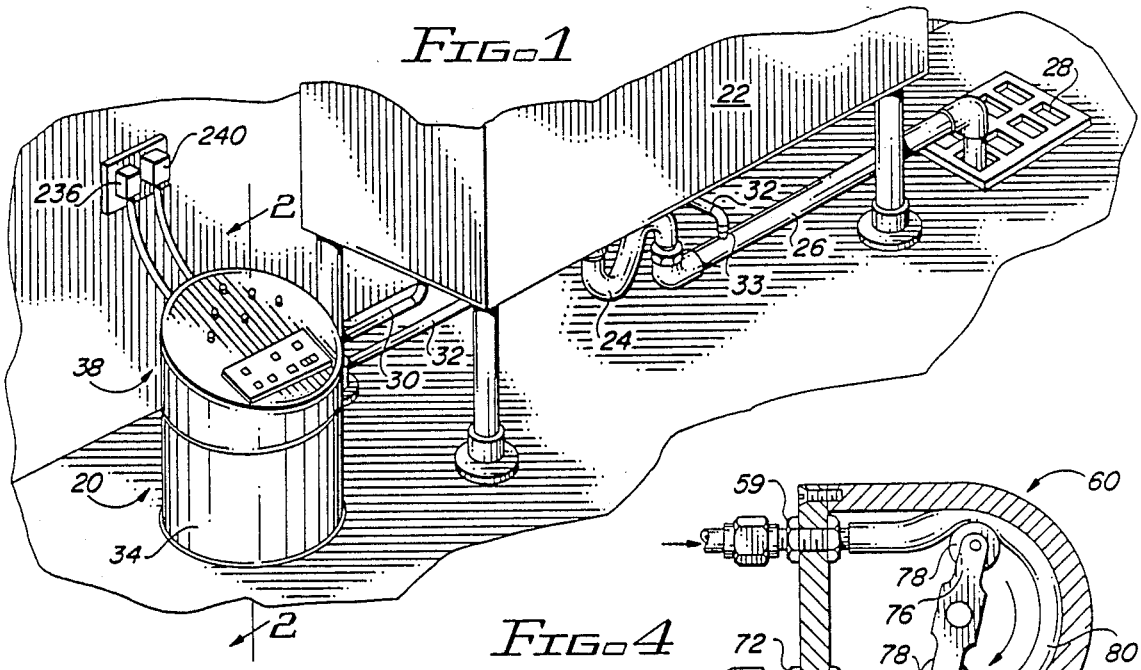
FIG. 1 is a perspective view of the automatic drain system treatment apparatus of the present invention showing the apparatus in a typical installation.

Referring more particularly to the drawings, FIG. 1 shows the automatic drain system treatment apparatus of the present invention which is indicated in its entirety by the reference numeral 20. FIG. 1 also shows the apparatus 20 as being installed in a typical working environment which will now be discussed to insure a complete understanding of the invention. FIG. 1 shows a sink 22 having a conventional pipe trap 24 with a drain conduit 26 extending therefrom into a grease trap 28, of the type commonly found in the kitchens of restaurants, cafeterias and other establishments where relatively large quantities of food are prepared. Such establishments have clogging problems with regard to the grease traps 28 and the drain systems (not shown) which are connected to receive and dispose of the liquids and other matter received in the grease traps 28. The clogging problem is due mainly from the oils, fats, grease and other contaminants which are used in preparing the food or are by-products of the food preparation process. Such contaminants tend to solidify and therefore, the grease traps 28 and the associated drain systems need to be cleaned periodically. As an alternative to physical cleaning of grease traps, special liquid formulations have been developed which when injected into grease traps on a regular basis, will overcome or at least substantially reduce grease trap and drain system clogging problems. By way of example, one particular formulation which is well suited for this purpose is available from Sybron Chemicals Inc., a subsidiary of Sybron Corporation, Birmingham Road, Birmingham, NJ 08011, and is identified as BI-CHEM TO-500L, with BI-CHEM being a registered trademark of Sybron Chemicals Inc. The formulation is a bioactive formulation based on liquid cultures which liquify and digest the contaminants which cause the grease trap and drain system clogging problems discussed above.

For reasons which will become apparent as this description progresses, the apparatus 20 is provided with a water inlet pipeline 30 which is coupled to receive water from a suitable source such as the usual cold water supply pipe (not shown) provided under the sink 22. The apparatus 20 is also provided with a liquid delivery conduit 32 by which liquids from the apparatus 20 are injected into the drain conduit 26 as shown at 33. Alternatively, the delivery conduit 32 may be disposed to empty directly into the grease trap 28.

Figure 2:
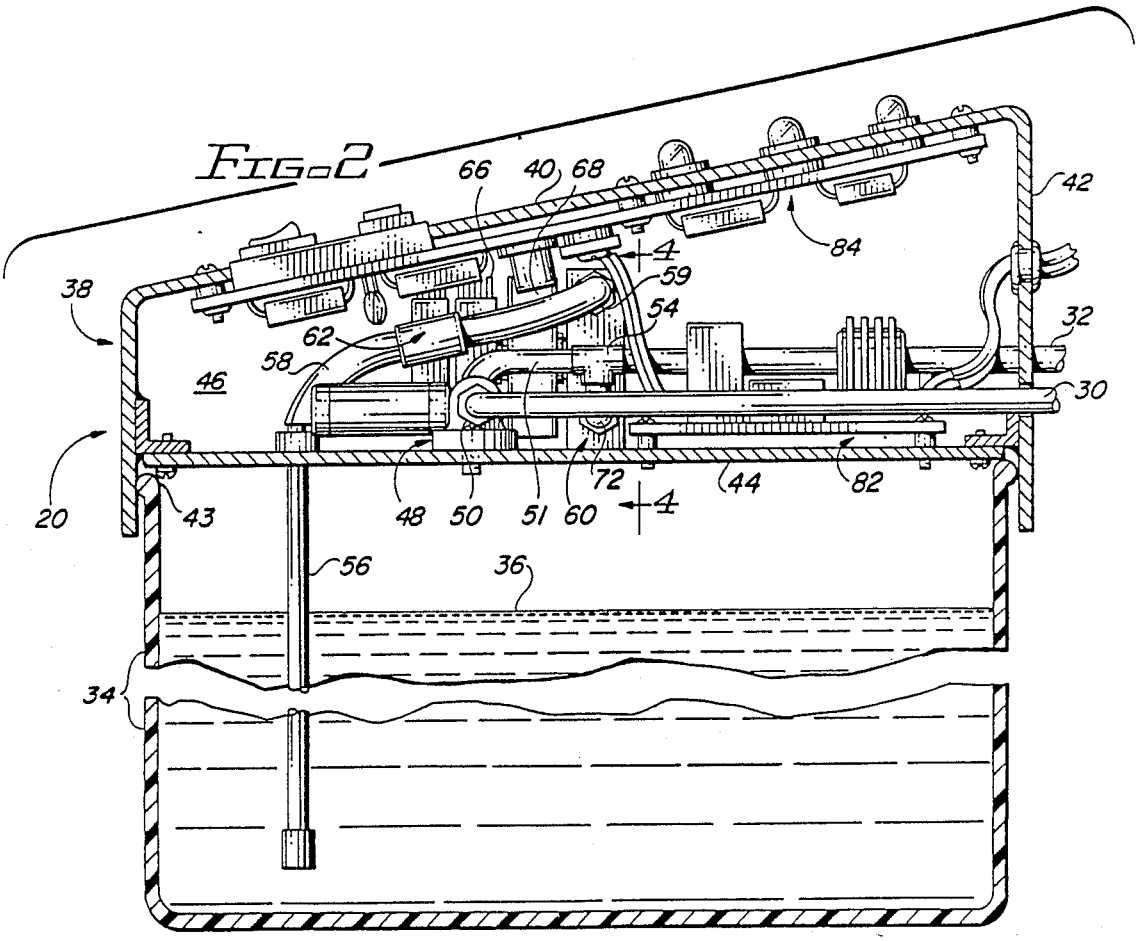
FIG. 2 is an enlarged fragmentary sectional view taken along the line 2—2 of FIG. 1.

As seen best in FIG. 2, the apparatus 20 includes an open top container 34 having a supply of the bioactive liquid cultures 36 therein, with the container being covered by an especially configured housing 38 which, in addition to serving as a cover, contains the various operational components of the apparatus. The cover 38 has a top wall 40 with an endless skirt 42 depending from the periphery of the top wall in surrounding relationship the upper rim 43 of the container 34. An upwardly recessed shelf 44 is mounted in the lower end of the housing 38 so as to be restingly supported on the rim 43 of the container 34, with the shelf cooperating with the top wall 40 and the skirt 42 to define an interior chamber 46 in which the above mentioned components of the apparatus 20 are mounted.

Figure 3:
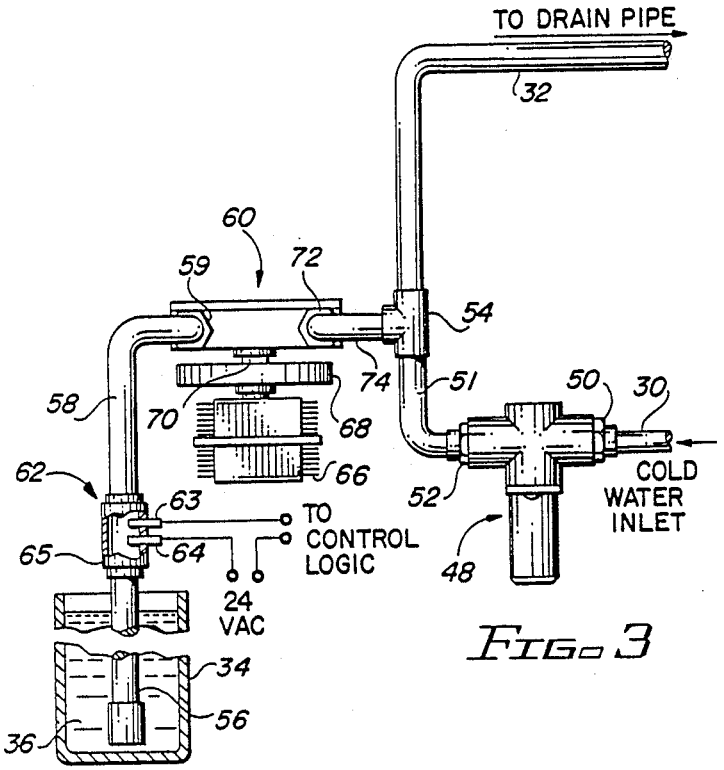
FIG. 3 is a diagrammatic view showing the liquid interconnection of the flushing valve, the supply of bioactive liquid cultures and the pump means which interact in accordance with the present invention to direct flushing water and the bioactive liquid cultures to a drain system.

As shown in FIGS. 2 and 3, a normally closed solenoid valve 48 is mounted on the shelf 44 of the housing 38, and the water inlet pipe 30 passes through the skirt 42 of the housing and is connected to the inlet boss 50 of the solenoid valve 48. A pipeline 51 extends from the outlet boss 52 of the solenoid valve 48 to a tee-fitting 54 from which the liquid delivery conduit 32 extends to the drain system to be treated as hereinbefore described. In view of this, it will be seen that cold water, i.e. room temperature, will be supplied to the drain system when the solenoid valve is energized to its open position for reasons which will be described below.

A suction tube 56 is carried by the shelf 44 of the housing 38 and extends therefrom into the supply of bioactive liquid cultures 36. A hose 58 is connected between the upper end of the suction tube 56 and the inlet port 59 of a pump 60, and a liquid supply sensor 62 is mounted in the hose 58. The liquid supply sensor 62 is provided to sense the presence or absence of the bioactive liquid cultures and provide an alarm signal whenever the supply of liquid cultures needs replenishing. When the pump 60 is being operated, 24 volts AC is supplied to a spaced apart pair of electrodes 63 and 64 that are carried in the sensor housing 65 so as to extend into the interior thereof. When liquid is present in the sensor housing 65, the liquid provides an electrically conductive path between the electrodes 63 and 64 thereby completing the circuit and sending a signal to the control logic as will hereinafter be described. When the supply of liquid cultures 36 is depleted, the electrically conductive pth between the electrodes 63 and 64 will disappear thus opening the circuit.

A suitable electric motor 66 is used to drive a gear box 68 which is coupled by a suitable driveshaft 70 to operate the pump 60. The pump 60 has an output port 72 which is connected by a pipeline 74 to the aforementioned tee-fitting 54 for directing the liquid cultures 36 into the liquid delivery conduit 32 and thus into the drain system to be treated.

Figure 4:
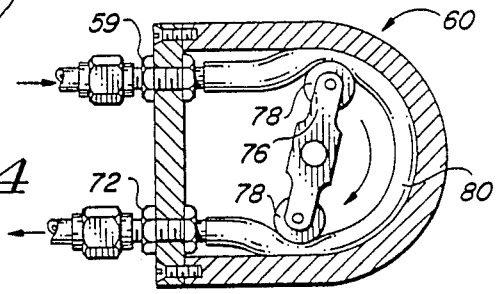
FIG. 4 is a sectional view taken along the line 4—4 of FIG. 2 and showing a preferred form of pump.

The pump 60 as shown in FIG. 4 is preferably a peristaltic pump of the well known type which is commonly used for metered pumping of chemicals. The bioactive liquid cultures are moved through the pump by rotation of the arm 76 which causes the rollers 78 that are carried on the opposite ends of the arm, to squeeze the tube 80.

The solenoid valve 48 is operated to provide the apparatus 20 with a flushing capability and the pump 60 is operated to inject the bioactive liquid cultures into the drain system and those operations are accomplished in accordance with a preferred operational sequence, or program. The program is carried out by electronic components and circuits which are carried on first and second circuit boards 82 and 84 that are mounted in the housing 38 as seen in FIG. 2.

Figure 5:
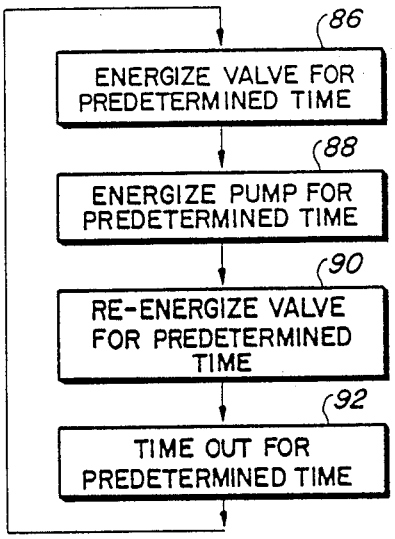
FIG. 5 is a flow diagram showing the preferred operational sequence of the apparatus of the present invention.

FIG. 5 shows the program in block form as including a first step 86 wherein the solenoid valve 48 is energized for an adjustably predetermined time, a second step 88 wherein the pump 60 is operated for an adjustably predetermined time, a third step 90 wherein the solenoid valve 48 is re-energized for and a second adjustably predetermined length of time and a fourth step 92 which is referred to as a "time out". The time out step is an adjustably predetermined interval between the end of the third step and the beginning of the next cycle of the program.

Figure 6:
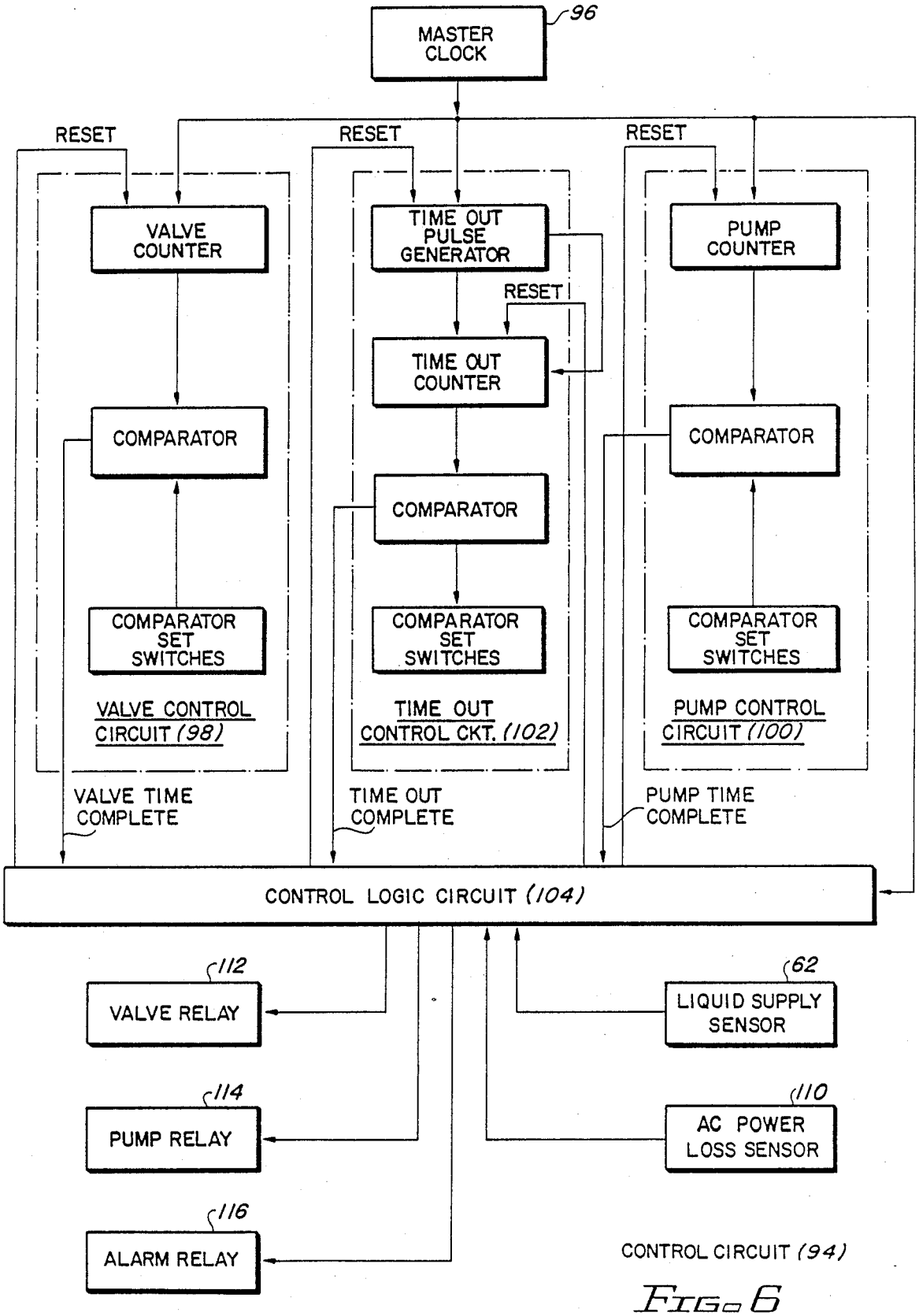
FIG. 6 is a schematic block diagram of the control circuit of the apparatus.

FIG. 6 is a block diagram of a control circuit 94 which causes the apparatus 20 to operate in accordance with the above described preferred program of FIG. 5. The control circuit 94 includes, as will hereinafter be described in detail, a master clock circuit 96, a valve control circuit 98, a pump control circuit 100, a time out control circuit 102 and a control logic circuit 104. The control logic circuit 104 receives signals from and sends signals to the valve, pump and time out control circuits 98, 100 and 102 respectively, and in addition, receives input signals from the liquid supply sensor 62, an AC power loss sensor 110, and also controls the energization of the valve relay 112, pump relay 114 and an alarm relay 116.

Figure 12:
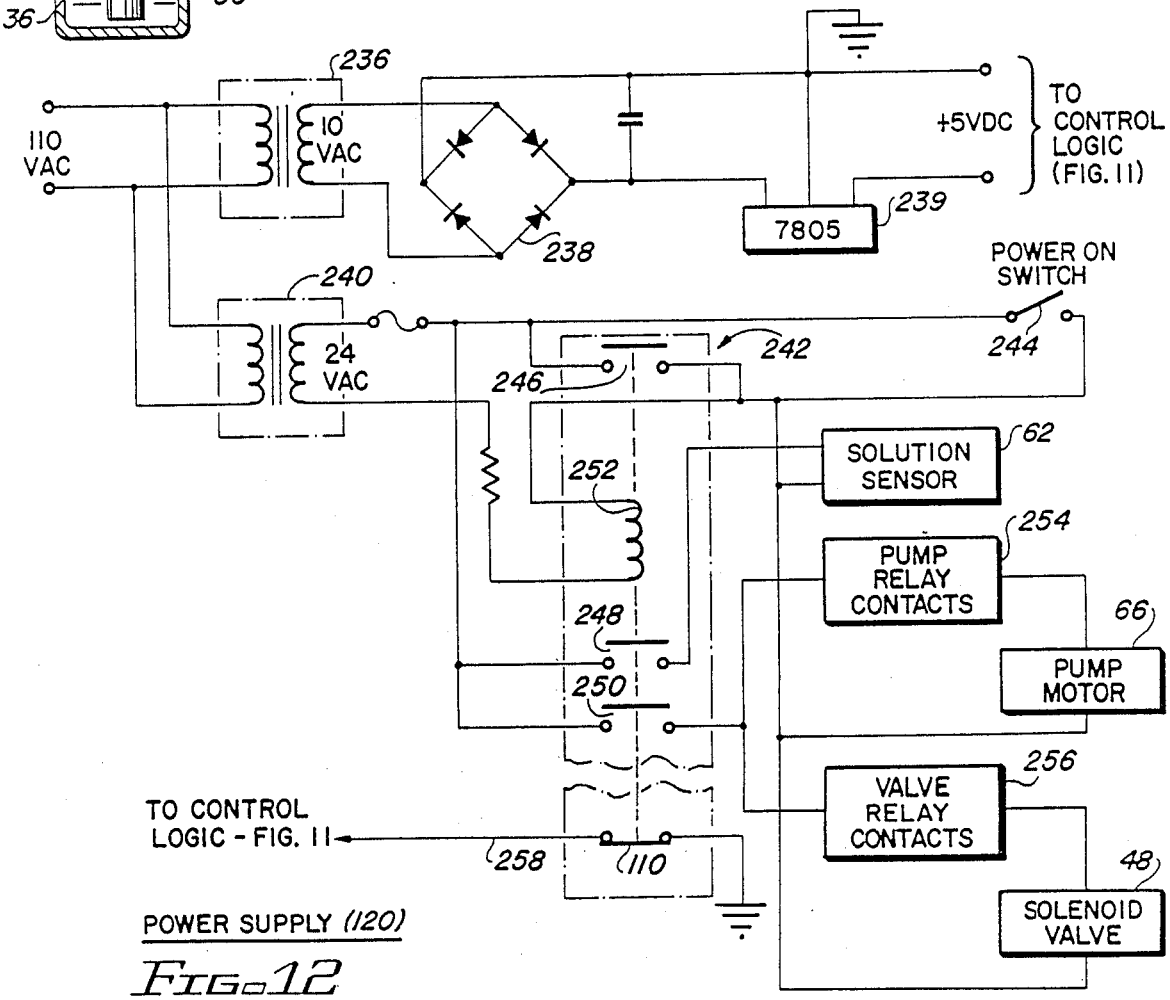
FIG. 12 is a schematic diagram of the power supply of the apparatus.
Figure 7:
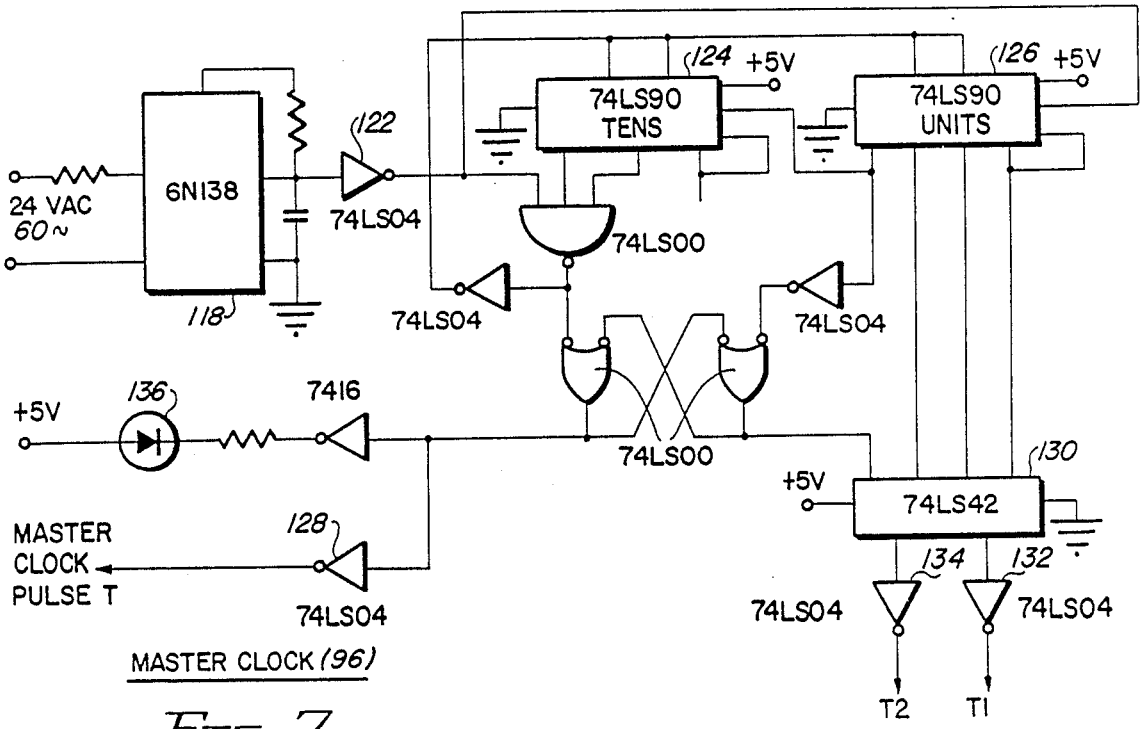
FIG. 7 is a schematic diagram of the master clock of the control circuit.

The master clock circuit 96, a circuit diagram of which is illustrated in FIG. 7, has 24 volt 60 cycle AC applied to an optical coupler 118 from a power supply module 120 which is shown in FIG. 12 and will be more fully described below. The output from the optical coupler 118 is applied through an inverter 122 to two decade counters 124 and 126, the outputs of which are directed through suitable logic circuits in a manner well known in the art to produce master clock pulses T and synchronization pulses T1 and T2. The master clock pulses T are produced by an inverter 128 with there being one master clock pulse T produced at substantially one second intervals. The other timing pulses T1 and T2 are produced by a BCD to decimal decoder 130 and are amplified and inverted by inverter circuits 132 and 134 respectively. The T1 and T2 timing pulses, which are also produced at one second intervals, are used at various points about the control circuit 94 to compensate for circuit delays, and to synchronize operations of the control circuit 94 with the master clock pulses T, as is well known in the art. As shown, the master clock circuit 96 may include a suitable operational indicator light 136, such as the illustrated light emitting diode, which is mounted on the top wall of the housing 38.

Figure 8:
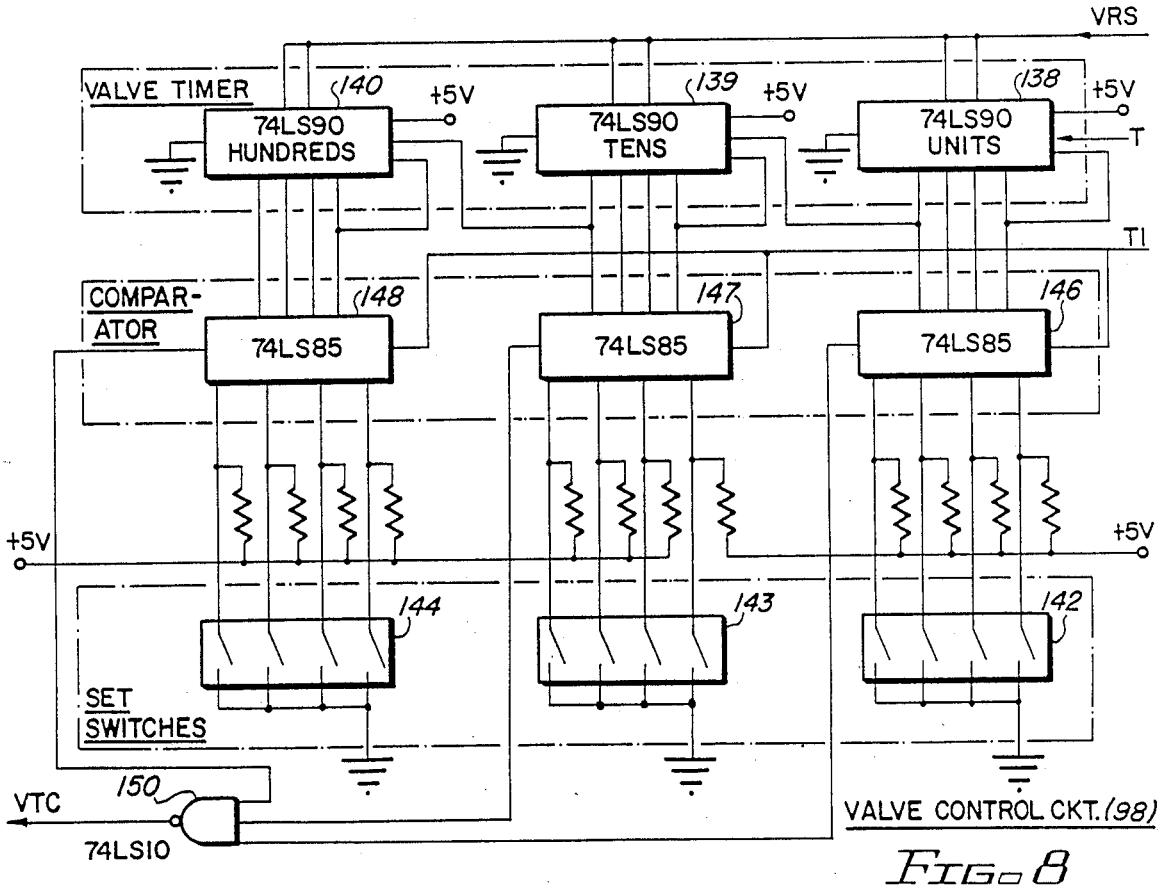
FIG. 8 is a schematic diagram of the valve timing control circuit.

In FIG. 8, details of valve control circuit 98 are illustrated. Valve control circuit 98 has three decade counters 138, 139, 140. Master clock pulses T are applied to the clock input terminal of units counter 138. The three counters 138, 139 and 140 have the capability of counting up to 999 master clock pulses T when counters 138, 139, and 140 are enabled by a valve reset signal (VRS) going negative or having a value of logic zero. The operator of the apparatus 20 determines the valve operating time period, i.e. the period of time when the valve 48 is energized to its open position by manually setting each of the three four positions DIP switches 142, 143 and 144. The number of clock pulses applied to counters 138, 139 and 140 after they are enabled by the VRS is compared by comparator 146, 147 and 148 with the number manually entered into switches 142, 143 and 144. When the number of master clock pulses T counted by the counters 138, 139 and 140 equals the number entered into the switches 142, 143 and 144, a valve time complete signal (VTC) is produced by the NAND gate 150.

Figure 9:
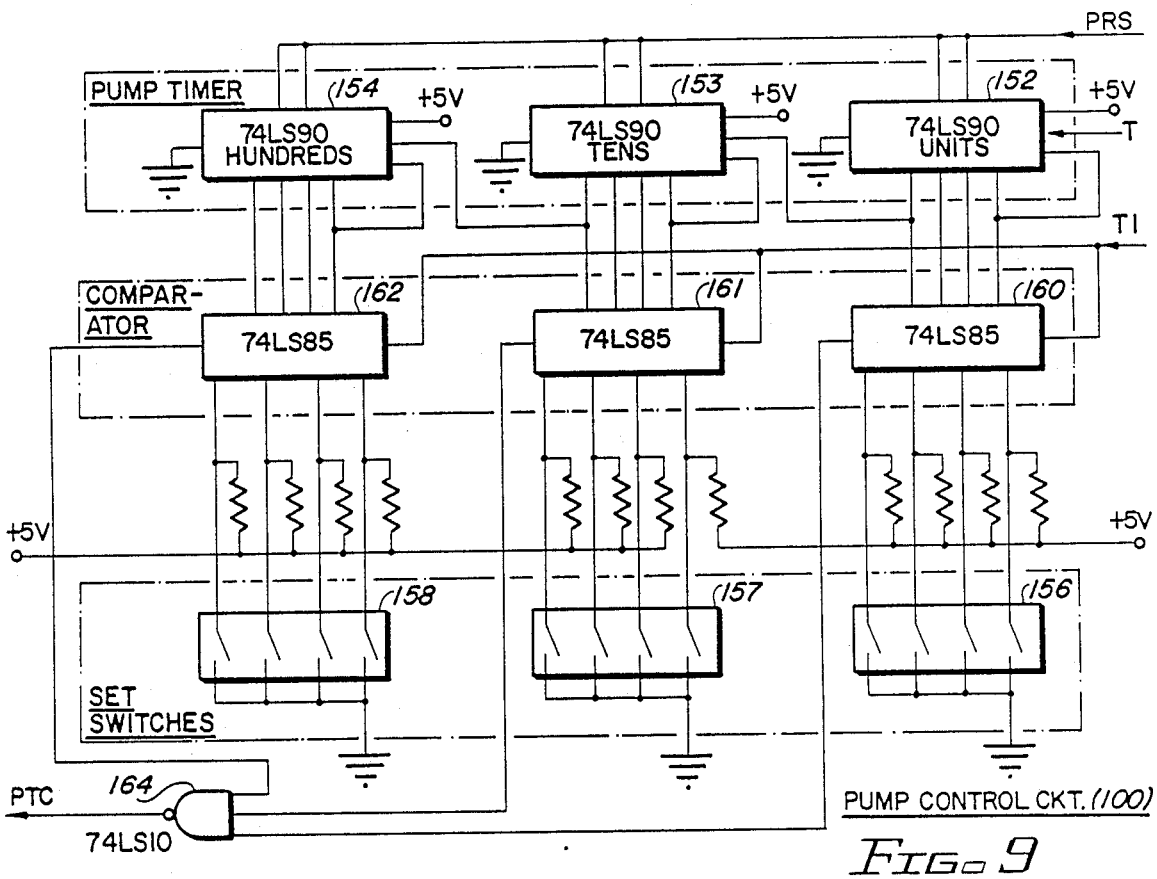
FIG. 9 is a schematic diagram of the pump timing control circuit.

In FIG. 9 circuit details of the preferred embodiment of pump control circuit 110 re illustrated. Pump control circuit 110 is essentially a duplicate of valve control circuit 98 and consists of three decade counters 152, 153 and 154, three DIP switches 156, 157 and 158 and three comparator 160, 161 and 162. When enabled by the pump reset signal (PRS) going negative, master clock pulses T are counted by counters 152, 153, and 154 until such count equals the number manually entered or set into switches 156, 157 and 158. When comparator 160, 161, and 162 determine that the two counts are equal, or compare, NAND gate 164 produces a pump time complete signal (PTC).

Figure 10:
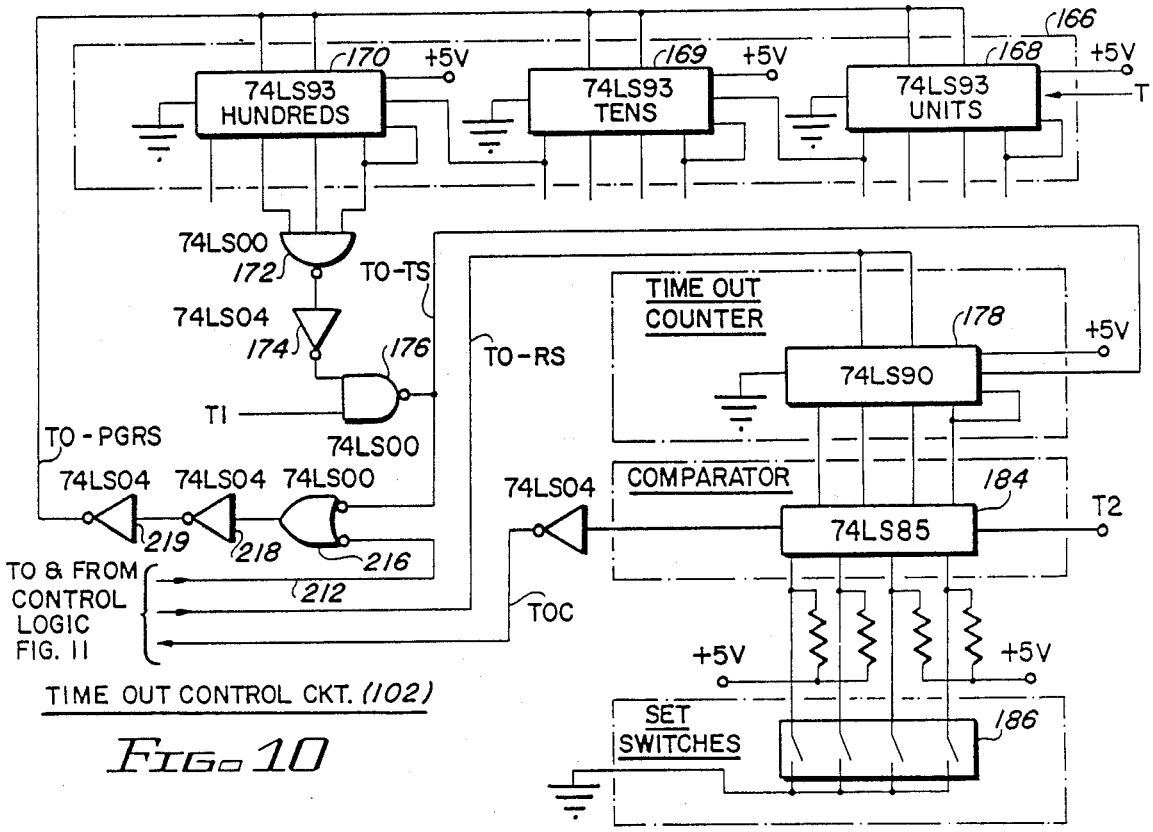
FIG. 10 is a schematic diagram of the time out control circuit.

The time out control circuit 102 as seen in FIG. 10 includes a time out pulse generator 166 having three binary counters 168, 169 and 170 which are connected in series with each other, and the master clock pulses T are applied to the clock input terminal of the counter 168. When the counters 168, 169 and 170 are enabled, by the time out pulse generator reset signal (TO-PGRS) going negative, NAND gate 172, to which selected outputs of the counter 170 are applied, will produce an output that is inverted by inverter 174, and that output is applied to one of the two input terminals of a NAND gate 176. The other input terminal of the NAND gate 176 has the synchronization pulse T1 from the master clock 96 applied thereto. The output of the NAND gate 176 is a time out trigger signal (TO-TS) that is produced when the number of master clock pulses T counted by the counters 168, 169 and 170, after being enabled, equals 1792 seconds. A TO-TS signal is produced by the NAND gate 176 every 29 minutes and 52 seconds, which amounts to one TO-TS signal approximately every half hour.

The time out control circuit 102 further includes a time out counter in the form of a decimal counter 178 having a clock input terminal to which TO-TS pulses from the NAND gate 176 is applied. The decimal counter 178 is enabled to count the TO-TS pulses when the time out reset signal TO-RS produced by NOR gate 180 (FIG. 11) goes negative which is any time other than when the manual reset switch 182 (FIG. 11) is closed, or when the time out complete signal TOC produced by the time out comparator 184 is negative. The length of time of the time out duration, in terms of half hour periods, is determined by the number manually entered into a four position DIP switch 186. The count manually entered into the switch 186 and the number of TO-TS pulses counted by the time out counter 178 are compared by the comparator 184 and when they are the same, or equal, the comparator 184 produces the above mentioned TOC signal.

The function of the control circuit 94, and particularly of the control logic circuit 104 after they are energized and the circuit 104 is initialized, is to execute the operational sequence or program of FIG. 5 as mentioned above. The first step, block 86 of FIG. 5, energizes the solenoid valve 48 from its normally closed state to its open state and it will be held open for an adjustably predetermined length of time which in the preferred embodiment is from 1–999 seconds which is the range of the timing capability of the hereinbefore described valve control circuit 98. The length of time that the valve 48 is energized, or opened, is determined by the count that is manually entered into the switches 142, 143 and 144 by the operator. When the solenoid valve 48 is energized, water at room temperature, i.e., at whatever temperature it is at when received from the suitable source as long as it is not hot, is directed through the valve 48, the liquid delivery conduit 32 into the drain system per se and into the grease trap 28 in particular. The purpose for the first flushing operation is to insure that the temperature of the contents of the grease trap 78 is below that which is critical to the functioning of the bioactive liquid cultures 36. The particular bioactive liquid cultures 36 mentioned above begin to lose their effectiveness at temperatures of approximately 120° F., and the contents of the grease trap 28 could very easily be at or above this temperature as a result of emptying hot water from a dishwasher or any other kitchen function which uses water at elevated temperatures. A second purpose for this first flushing operation is to purge, or at least reduce the concentration of any caustic compounds, chlorine, or any other bacteria killing additives which could kill the liquid cultures. When the predetermined time during which the valve 48 is open, has elapsed, the valve control circuit 98 produces the valve time complete signal (VTC) which de-energizes the solenoid valve 48 and results in the program entering into the second step block 88 of FIG. 5.

In the second step, the pump 60 is operated for an adjustably predetermined length of time, i.e. the count entered into the switches 156, 157 and 158 of the pump control circuit 100, with that time preferably being from 1–999 which is the range of the timing capability of the pump control circuit 100. The purpose for this second step is, of course, to inject the bioactive liquid cultures 36 into the grease trap 28 so that it will liquify and digest the contaminants in the grease trap. When the predetermined pump operating time has elapsed, the pump control circuit 100 produces the pump time complete signal (PTC) which turns off the pump 60 and enables the control circuit 94 to begin execution of step three block 90 of the program of FIG. 5.

The third step of the program commences with re-energization of the solenoid valve 48 for a length of time equal to the count manually set into the switches 142, 143 and 144 of the valve control circuit 98. This re-energization step, as with the first step, flushes the grease trap 28 with fresh water to wash the liquified and digested contaminants into the drain system. When the length of time of this third step block 90 has lapsed, the valve control circuit 98 will once again produce the valve time complete signal (VTC) and when this signal is produced during execution of the step three block 92, the control circuit 94 is enabled to begin execution of step four block 92 of the program of FIG. 5.

Figure 11:
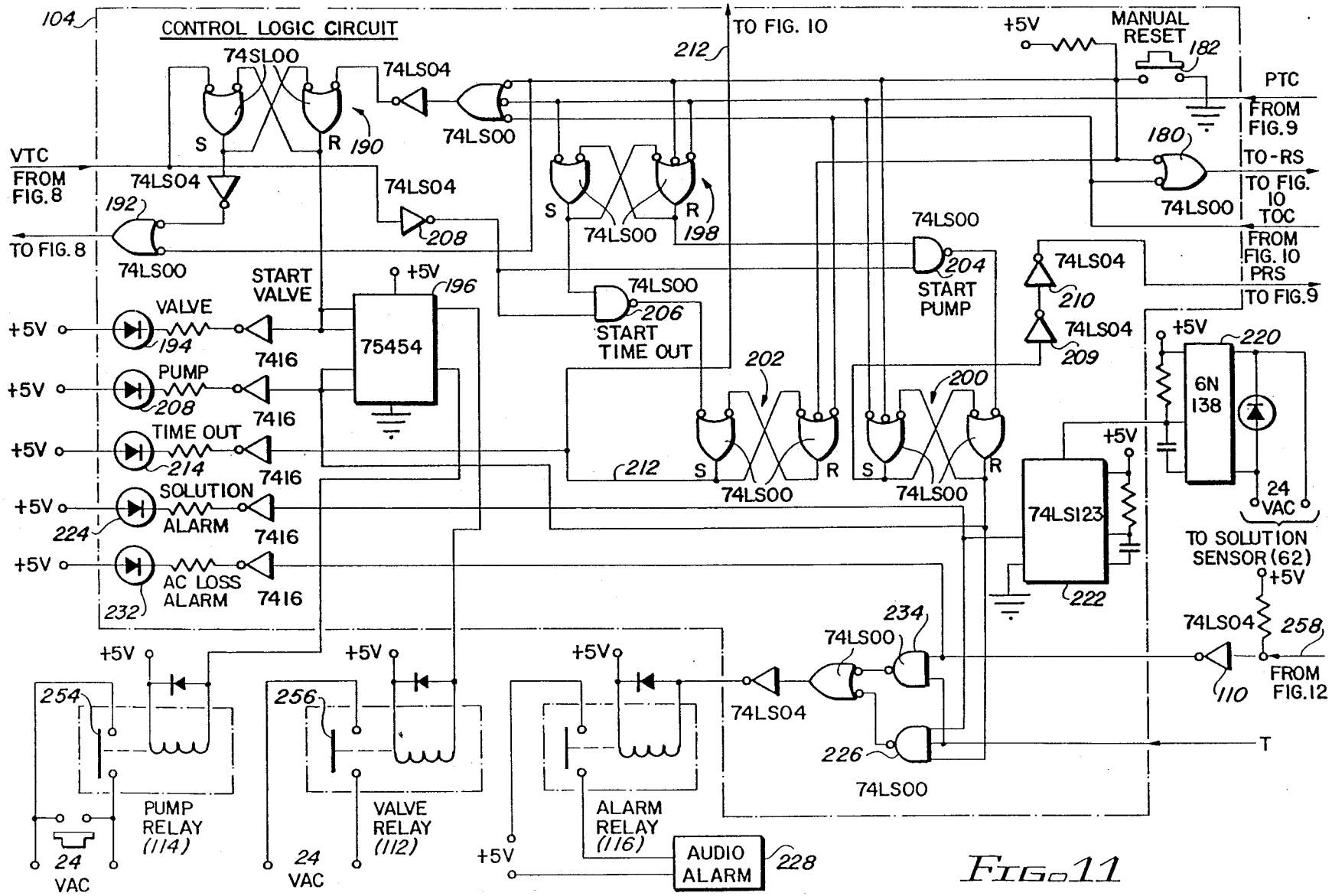
FIG. 11 is a schematic diagram of the control logic of the control circuit.

As hereinbefore described, the decimal counter 178 of the time out control circuit 102 is enabled to count the TO-TS pulses from the time out pulse generator 166 when the decimal counter 178 is enabled by the time out reset signal (TO-RS) produced by the NOR gate 180 (FIG. 11). The TO-TS pulses produced by the time out pulse generator 166 occurs approximately every ½ hour (1792 seconds to be exact). The four position DIP switch 186 of the time out control circuit 102 can be set to any value between 1–9 so that the time out period can be selected to run from approximately ½ hour to 4½ hours. Thus, during this adjustably predetermined duration of the time out period, the solenoid valve 48 will remain de-energized (closed) and the pump 60 will remain inoperative. When the predetermined time out duration has elapsed, the comparator 184 produces the TOC pulse which enables the valve control circuit 98 to become operational once again. In otherwords, the preferred operational sequence, or program, of FIG. 5 is permitted to start another cycle of operation.

The control logic circuit 104 seen best in FIG. 11 receives and produces the various input and control logic signals mentioned above and therefore implements and executes the program of FIG. 5, as will now be described.

The reference numeral 190 of FIG. 11 identifies the valve control flip-flop which when reset so that its reset terminal R is high +5 volts DC or a logic 1, causes the valve reset signal (VRS) produced by the NOR gate 192 to go low, or to ground potential which, among other things, enable counters 138, 139 and 140 of the valve control circuit 98 to count the master clock pulses T. The signal VRS is produced by inverting the S output of the valve control flip-flop 190 which is low when the valve control flip-flop 190 is reset, and this results in the output of the NOR gate 192 being low, or a logic zero signal. The high, or logic 1, output of the R terminal of the valve control clip-flop 190, when reset, causes a valve operating light emitting diode (LED) 194 to be energized, and by operation of a dual inverter driver circuit 196, energizes the valve relay 112 which applies 24 volts AC to the solenoid valve 48 to energize, or open, the valve.

When the predetermined time of valve operation is completed, the valve time complete signal VTC is produced by the valve control circuit 98 and is applied to the valve control flip-flop 190 for setting thereof, and depending on the state of a pump or time out flip-flop 198, will either reset a pump control flip-flop 200 or a time out flip-flop 202. When the manual reset switch 182 is closed momentarily for initializing the control logic circuit 104, it, among other things, resets the valve control flip-flop 190, the pump or time out flip-flop 200 and the time out flip-flop 202. Closing of the manual reset switch 182 also sets the pump control flip-flop 200 and causes the VRS produced by the NAND gate 192 to go positive to clear the counters 138, 139 and 140 of the valve control circuit 98 provided that the VRS signal was not already positive at the time the manual switch 182 is closed. Immediately after initialization of the control logic circuit 104, the pump or time out flip-flop 198 is reset as mentioned above, so that a logic 1 signal is produced by its reset terminal R which provides one input to a NAND gate 204, and a logic zero is applied to one of the inputs of a NAND gate 206 by the set terminal of the pump or time out flip-flop 198. Thus, when the VTC signal goes negative, it sets the valve control flip-flop 190, turns off the valve operating LED 194, de-energizes the valve relay 112 and the VRS signal goes positive clearing the counters 138, 139 and 140 and preventing them from counting master clock pulses T as long as the VRS is high. The VTC signal is inverted by the inverter 208 which applies a logic 1 signal to the other input terminals of the NAND gates 204 and 206. The NAND gate 204 under these circumstances produces a logic zero signal which resets the pump control flip-flop 200. When the pump control flip-flop 200 is reset, a logic 1 signal at its reset terminal re-energizes the pump operating light emitting diode (LED) 208 and the driver circuit 196 which energizes the pump relay 114 which applies 24 volts AC to the pump's motor 66. The logic zero signal at the S terminal of the pump control flip-flop 200 passes through two inverter driver circuits 209 and 210 and becomes the pump reset signal (PRS) which enables the counters 152, 153 and 154 of the pump control circuit 100 (FIG. 9) to count the master clock pulses T that are applied to the clock input terminal of the counter 152. When the adjustably predetermined pump operating time expires, the pump control circuit 100 produces the pump time complete signal (PTC) as hereinbefore described. When the PTC signal is produced, it sets the pump control flip-flop 200, the pump or time out flip-flop 198 and resets the valve control flip-flop 190. Setting of the pump control flip-flop 200 turns off the pump operating LED 208 and de-energizes the pump relay 114 which stops operation of the pump 60. The PRS signal from the pump control flip-flop 200 goes positive when that flip-flop 200 is set which clears the counters 152, 153 and 154 of the pump control circuit 100.

When the valve control flip-flop 190 is reset upon production of the PTC signal as described immediately above, the third step block 90 of the program of FIG. 5 begins. This re-energization of the solenoid valve 48 under the control of the valve control circuit 98 is the same as the operation during the first step, block 86 of the program of FIG. 5. At the end of the adjustably predetermined time of re-energization of the solenoid valve 48, the valve control circuit 94 produces the VTC signal, i.e. the VTC signal goes negative, the valve control flip-flop 190 is again set which turns off the valve operating LED 194, de-energizes the valve relay 112 and the valve reset signal (VRS) goes positive to clear the counters 138, 139 and 140 of the valve control circuit 98 and to prevent them from counting the master clock pulses T that are applied to the counter 138 thereof.

At this time, i.e. at completion of the third step, block 90 of the program of FIG. 5, the two inputs to NAND gate 206 are both logic 1 which causes that gate 206 to produce a logic zero output that sets the time out flip-flop 202. When set, a signal 212 present at the S terminal of the time out flip-flop 202 causes the time out indicator light emitting diode 214 to be energized. That same set signal 212 is also applied to one input of a NOR gate 216 (FIG. 10) and passes through two inverters 218 and 219 to produce the previously described time out pulse generator reset signal (TO-PGRS) which is applied to the counters 168, 169 and 170 so that the master clock pulses T applied to the counter 168 of the time out pulse generator 166 can be counted. As hereinbefore described, the decimal counter 178 is enabled, except when the manual reset switch 182 is closed, or when the time out complete (TOC) signal is produced, i.e. goes negative at the end of each time out period, so that the counter 178 can count the TO-TS pulses produced by the NAND gate 176. When the TOC signal is produced, i.e. goes negative, by the comparator 184, the TOC signal resets the time out flip-flop 202, the pump or time out flip-flop 198 and the valve control flip-flop 190. When all of this occurs, one cycle of the preferred operational sequence is completed and a new cycle is started.

As hereinbefore mentioned, the apparatus 20 includes a liquid supply sensor 62 which is provided to detect the absence of the bioactive liquid cultures 36 and sound an alarm whenever the supply needs to be replenished. The sensor 62 applies a 24 volts AC across the input terminals of an optical coupler 220 (FIG. 11). As long as that AC voltage is applied to the optical coupler 220, a one shot flip-flop 222 will produce a logic zero output which maintains a solution alarm indicator light emitting diode (LED) 224 off. When the solution sensor 62 detects the depletion of the bioactive liquid cultures supply 36, the removal of the 24 volt AC from the terminals of the optical coupler 220 will cause the one shot flip-flop 222 to produce a logic 1 output. The logic 1 output of the one shot flip-flop 222 turns on the LED 224 to provide a visual indication of the depletion of the liquid cultures 36. The logic 1 output of the one shot flip-flop 222 is also applied to one of the input terminals of a three input NAND gate 226, with a second input to that gate 226 being the pulses T from the master clock 96 and a third input being the pump energizing output signal from the R terminal of the pump control flip-flop 200. Thus, when the pump control flip-flop 200 is reset and the pump 60 is operating and no solution is being sensed by the solution sensor 62, the alarm relay 116 will be energized by the output of the NAND gate 226 to operate an audio alarm means 228 to produce a pulsating warning sound, i.e. one pulse per second.

In the event of a 110 volt AC power loss, the logic level voltage, i.e. +5 volts DC will automatically be reapplied to all required locations within the control circuit 94 when the AC power is restored. However, as will hereinafter be described in detail, the operating voltage, i.e. 24 volts AC will not be automatically restored, and operator intervention is needed. To insure such intervention, the previously mentioned AC power loss sensor 110 is operable to enable an inverter 230 (FIG. 11) causing it to produce a high output, upon restoration of the 110 volt AC power, and that high output turns on the AC loss indicator light emitting diode (LED) 232. The output of the inverter 230 is also anded with the master clock pulses T by a NAND gate 234 for energizing the alarm relay 116, which, as above, causes the alarm means to produce a pulsating warning sound. The alarm means 228 will operate whenever there is a loss of 110 volt AC power and/or when the liquid culture supply 36 needs to be replenished, and an operator can easily identify which condition is at fault by simply looking at the LED's 222 and 232.

The power supply module 120 which operates the apparatus 20 may be connected to any suitable source of AC power such as the 110 volt AC supply suggested above. As shown in FIG. 12, the 110 volts AC is applied across the input winding of a first step down transformer 236 the output of which is approximately 10 volts AC. That voltage is applied to a full wave rectifier circuit 238 which, in conjunction with a voltage regulator 239 produces a 5 volt DC logic level output voltage that is applied to the various logic circuits about the control circuit 94 as indicated.

A second step down transformer 240 produces the 24 volt AC power output across its output windings, and a power relay 242 needs to be energized to apply the 24 volts AC power to the solution sensor 62, the pump 60, the solenoid valve 48, and to deactivate the power loss sensor 110 as will hereinafter be described. The power relay 242 is energized by closing of a manually operated power on switch 244 so that the normally open contacts 246, 248 and 250 of the relay will be moved to their closed positions and the normally closed contacts which provide the AC power loss sensor 110 will be opened. When the power on switch 244 is closed, current will flow through the coil 252 of the relay closing the power contacts 246 so that 24 volts AC will flow through the coil 252 even though the power switch 244 is no longer being manually depressed, or closed. Energization of the power relay 242 will also close the relay contacts 248 to apply power to the solution sensor 62 and close the contacts 250 which applies the 24 volt AC power to the contacts 254 of the pump relay 144 and contacts 256 of the valve relay 112. Therefore, when the pump relay 114 is energized 24 volts AC will be applied across the closed contacts 254 of the pump relay to operate the pump 60 and when the valve relay 112 is energized, 24 volts AC will be applied across the closed contacts 256 of the valve relay to energize the solenoid valve 48.

However, if the 110 volts AC is interrupted for more than a few cycles, the power relay 242 will be de-energized opening contacts 246, 248 and 250 which, of course interrupts the application of 24 volts AC to all locations of the apparatus 20. As previously mentioned, even when the 110 volts AC power is restored, the 5 volts DC will be returned immediately, but the 24 volts AC will not be available for operation of the apparatus 20 until the power on switch 244 is manually depressed to re-energize the power relay 242. This is where the AC power loss sensor 110 takes over to remind the operator that it is necessary to depress the power on switch 244 and that it is desirable to also press the manual reset switch 182 (FIG. 11).

The power loss sensor 110 is in the form of the hereinbefore mentioned normally closed contacts of the power relay 242. When the relay 242 is de-energized the power loss sensor contacts 110 are closed which connects a conductor 258 to ground. The conductor 258 is connected to the inverter 230 (FIG. 11). When the power relay 242 is de-energized, indicating a 110 AC power loss, the loss sensor contacts 110 are closed which grounds the +5 volts DC that is applied to the input terminal of the inverter 230. When this happens, the output of the inverter 230 goes high which illuminates the LED 232 and activates the audio alarm 228 as previously described.

When starting operation of the apparatus 20, or restarting its operation such as after the loss and restoration of power, it is desirable that the manual reset switch 182 (FIG. 11) be closed for initialization of the control circuit 94 so that the preferred operational sequence, or program, of FIG. 5 will be accomplished in the manner described and at the adjustably predetermined times set by the operator.

As is well known in the art, the various discrete circuits, i.e. the gates, inverters, counters and the like, which make up the control circuit 94 are each well known and are commercially available from various manufacturers and are identified by standardized identification indicia. For completeness of this disclosure, the identification indicia of the various discrete circuits are provided on the drawings.

It will be readily apparent to those skilled in the art that the operation of the apparatus 20, and the execution of the preferred operational sequence could be accomplished by means other than the above described control circuit 94. For example, the entire operation could be accomplished by an appropriately programmed micro-processor.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What we claim is:

1. An automatic drain system treatment apparatus comprising:

(a) a supply of bioactive liquid cultures;

(b) a pump having an inlet coupled to said supply of bioactive liquid cultures, an outlet and movable means mounted within said pump between said inlet and outlet for moving said bioactive liquid cultures through said pump;

(c) a valve means for operation thereof between opened and closed states, said valve having an inlet for connection to a source of fresh water under pressure and having an outlet;

(d) a liquid delivery conduit coupled to the outlet of said pump and to the outlet of said valve for receiving fresh water from said valve and directing the received bioactive liquid cultures and the received fresh water to a drain system to be treated; and (e) control means coupled to said pump and to said valve for automatic operation thereof in accordance with a predetermined operational sequence and for individually adjustable time periods.

2. An automatic drain system treatment apparatus as claimed in claim 1 and further comprising means for sensing the depletion of said supply of bioactive liquid cultures and producing an alarm signal indicative of the depletion.

3. An automatic drain system treatment apparatus as claimed in claim 1 and further comprising:
(a) said pump is electrically operated; and
(b) said valve is normally closed and said means for operation thereof is a solenoid.

4. An automatic drain system treatment apparatus as claimed in claim 3 wherein said control means comprises:
(a) valve control circuit means coupled to the solenoid of said valve for actuating said valve to its open state for an adjustably predetermined length of time;
(b) pump control circuit means coupled to operate said pump for an adjustably predetermined length of time;
(c) time out control circuit means for preventing actuation of said valve and operation of said pump for an adjustably predetermined length of time; and
(d) circuit means for sequentially and repeatedly enabling said valve control circuit means to actuate said valve followed by enabling of said pump control circuit means for operation of said pump followed by enabling of said time out control circuit means.

5. An automatic drain system treatment apparatus as claimed in claim 3 wherein said control means comprises:
(a) valve control circuit means coupled to the solenoid of said valve for actuating said valve to its open state for an adjustably predetermined length of time;
(b) pump control circuit means coupled to operate said pump for an adjustably predetermined length of time;
(c) time out control circuit means for preventing actuation of said valve and operation of said pump for an adjustably predetermined length of time; and
(d) circuit means for sequentially and repeatedly enabling said valve control circuit means for actuation of said valve followed by enabling of said pump control circuit means for operation of said pump followed by re-enabling of said valve control circuit means for reactivation of said valve followed by enabling of said time out control circuit means.

6. An automatic drain system treatment apparatus comprising:
(a) a supply of bioactive liquid cultures;
(b) an electrically operated pump having an inlet coupled to said supply of bioactive liquid cultures and having an outlet;
(c) a normally closed solenoid valve having an inlet for connection to a supply of fresh water under pressure and having an outlet;
(d) a liquid delivery conduit coupled to the outlet of said pump and to the outlet of said valve for receiving bioactive liquid cultures from said pump and for receiving fresh water from said valve and directing the received bioactive liquid cultures and the received fresh water to a drain system to be treated; and
(e) control circuit means coupled to said pump and to said valve for sequentially actuating said valve for directing fresh water into the drain system to be treated for a predetermined length of time, operating said pump for directing bioactive liquid cultures into the drain system to be treated for a predetermined length of time, reactuating said valve for again directing fresh water into the drain system to be treated for a predetermined period of time and continually repeating this sequence with a time out period of predetermined duration therebetween.

7. An automatic drain system treatment apparatus as claimed in claim 6 wherein said control circuit means includes means for adjusting the length of time of actuation of said valve.

8. An automatic drain system treatment apparatus as claimed in claim 6 wherein said control circuit means includes means for adjusting the length of time of operation of said pump.

9. An automatic drain system treatment apparatus as claimed in claim 6 wherein said control circuit means includes means for adjusting the duration of the time out period.

10. An automatic drain system treatment apparatus as claimed in claim 6 and further comprising:
(a) means for sensing the depletion of said supply of bioactive liquid cultures and producing a signal indicative of the depletion; and
(b) alarm means coupled to receive the signal produced by said means for sensing the depletion of the bioactive liquid cultures supply for producing an alarm upon receipt of that signal.

11. An automatic drain system treatment apparatus as claimed in claim 6 and further comprising:
(a) means for sensing the loss of electric power to said control circuit means and producing a signal indicative of that loss; and
(b) alarm means coupled to receive the signal produced by said means for sensing the loss of electric power for producing an alarm upon receipt of that signal.

12. Automatic treatment apparatus for cleaning a drain system comprising:
means for supplying fresh water to a drain system for initially flushing the system;
a supply of bioactive liquid culture;
means for supplying said bioactive liquid culture to the drain system subsequent to the supply of fresh water thereto, comprising a pump means with an inlet means coupled to said supply of bioactive liquid culture, an outlet means, and moveable means mounted within said pump between said inlet and outlet for moving said bioactive liquid culture through said pump means;
means for resupplying fresh water to said drain system after said bioactive liquid culture has been supplied to the drain; and
control means for repeatedly actuating each of said means for supplying fresh water, said means for supplying the bioactive liquid culture, and said means for resupplying fresh water, in sequence and for predetermined periods of time.

13. Automatic treatment apparatus as defined in claim 12 and further including means for sensing depletion of the bioactive liquid culture and for producing an alarm signal indicative of the depletion.

14. Automatic treatment apparatus as defined in claim 12 wherein the drain system includes a grease trap, and wherein the bioactive liquid culture is formulated to liquify and digest contaminants in the grease trap.

* * * * *